US007303449B2

(12) United States Patent
Lappöhn

(10) Patent No.: US 7,303,449 B2
(45) Date of Patent: Dec. 4, 2007

(54) SPRING BUSHING FOR MINIATURE PLUG-IN CONNECTORS HAVING CONTACT SPRING WITH INSERTION DEPTH EQUAL TO OR LESS THAN INSERTION WIDTH

(75) Inventor: Jürgen Lappöhn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/369,769

(22) Filed: Mar. 7, 2006

(65) Prior Publication Data

US 2006/0205283 A1 Sep. 14, 2006

(30) Foreign Application Priority Data

Mar. 9, 2005 (DE) ..... 10 2005 010 704

(51) Int. Cl.
*H01R 4/48* (2006.01)

(52) U.S. Cl. ..... 439/862

(58) Field of Classification Search ..... 439/857, 439/862, 682, 249
See application file for complete search history.

(56) References Cited

U.S. PATENT DOCUMENTS 4,203,646 A * 5/1980 Desso et al. ..... 439/724
4,978,307 A * 12/1990 Billman et al. ..... 439/83
4,990,110 A * 2/1991 Byrne ..... 439/861
5,024,610 A * 6/1991 French et al. ..... 439/857
5,024,627 A * 6/1991 Bennett et al. ..... 439/631
5,564,952 A 10/1996 Davis
5,582,519 A 12/1996 Buchter
6,102,754 A 8/2000 Capper et al.
6,280,230 B1 * 8/2001 Takase et al. ..... 439/397
6,299,492 B1 * 10/2001 Pierini et al. ..... 439/884
6,488,549 B1 12/2002 Weller et al.
6,556,411 B1 * 4/2003 Hoeft et al. ..... 361/119
6,814,598 B2 11/2004 Hoffmann et al.
7,140,895 B2 * 11/2006 Tuin et al. ..... 439/246
2001/0021609 A1 * 9/2001 Chiang ..... 439/682

FOREIGN PATENT DOCUMENTS

DE 87 10 419 1/1988
DE 90 03 748 7/1991
DE 93 10 600 11/1993
DE 197 24 581 12/1998
DE 202 03 083 7/2002

* cited by examiner

*Primary Examiner*—Chandrika Prasad
(74) *Attorney, Agent, or Firm*—Collard & Roe, P.C.

(57) ABSTRACT

A spring bushing for miniature plug-in connectors, has at least one housing chamber in a bushing housing, for accommodating a one-piece contact spring, the contact-giving spring tongues of which are bent out of a flat sheet-metal punched part, at least on one side, without coverage, whereby the one end of the sheet-metal punched part, a crosspiece that carries the spring tongues, forms a fixed connector, and the other free end forms the accommodation region for a contact blade. The insertion depth of the contact spring for a contact blade is equal to or less than its insertion width.

10 Claims, 2 Drawing Sheets

SPRING BUSHING FOR MINIATURE PLUG-IN CONNECTORS HAVING CONTACT SPRING WITH INSERTION DEPTH EQUAL TO OR LESS THAN INSERTION WIDTH

CROSS REFERENCE TO RELATED APPLICATIONS

Applicant claims priority under 35 U.S.C. §119 of German Application No. 10 2005 010 704.4 filed on Mar. 9, 2005.

BACKGROUND OF THE INVENTION

The present invention relates to a spring bushing for miniature plug-in connectors, having at least one housing chamber in a bushing housing, for accommodating a one-part contact spring, the contact-giving spring tongues of which are bent out of a flat sheet-metal punched part, at least on one side, without coverage. The one end of the sheet-metal punched part, a crosspiece that carries the spring tongues, forms a fixed connector, and the other free end forms the accommodation region for a contact blade.

The Prior Art

Usually, contact springs are punched out of a plate, in U shape, whereby the two U-shanks, which form spring shanks, are subsequently rotated relative to one another with regard to the U-crosspiece, thereby causing the U-shanks to lie precisely opposite one another and to form the accommodation for a contact blade. The punching scrap and the production effort and expense are accordingly high. Measured by the available starting material of sheet metal for punching, the punching scrap reduces the possible current carrying capacity of a contact spring. Furthermore, the region in which the U-shanks are rotated relative to one another is not available for contacting with the contact blade and for the production of spring forces, and this unavailability regularly causes the contact springs and therefore the spring bushings to become very long.

A spring contact for electronic components is previously known from DE 87 10 419 U1, in which the spring shanks are uncovered relative to one another, in that one of the spring shanks is cut out of the plane of the other spring shank and bent out. The crosspiece carries contact pins for circuit board assembly. In this way, the punching material is utilized in optimal manner. But this spring contact, too, has relatively long spring shanks, and these long spring shanks have a negative effect on the tolerances in the plug-in depth, the plug-in reliability of the blade contact, and the current carrying capacity, particularly for applications in multi-point miniature bushings, such as female multi-point connectors. Furthermore, a great plug-in depth also requires a correspondingly great construction height of the bushing and of the counter-plug part.

A one-piece pin structure of an electrical connector terminal for affixing electrical or electronic components on a circuit board is also known from DE 93 10 600 U1, which has a clamp holder segment, a carrier segment, a retention segment, and a connection pin segment, and thereby has a very long construction length, in total. The clamp holder segment is formed by two spring arms, in order to engage with and clamp a counter-contact pin of a component. The spring arms have a common base, which is connected with the carrier segment, whereby the two arms branch off from one another from there. A shorter, center arm is cut out of a sheet-metal part for this purpose, and bent, in such a manner that the counter-arm whose two outer arm parts are connected at the free end is formed from the remaining sheet-metal segment.

Furthermore, a plug-in sleeve for circuit boards is known from DE 197 24 581 A1, which contains clamping elements in a housing, for insertion of counter-blades. A clamping element is formed from sheet metal, as a one-piece punched part. The clamping element contains two flat arms that lie in a common plane, between which a tongue is disposed, separated by a slot, in each instance. The tongue is connected with a crosspiece that connects the two arms, and bent away so that it runs upward out of the plane of the arms in its region directly adjacent to the crosspiece, and subsequently comes close to the top side of the arms again. In a straight-line extension of the arms, two projections to be pressed into the circuit board are molded on, on the far side of the crosspiece. Shoulders on the outside edges of the arms delimit the push-in path into the housing. This clamping element, too, still possesses a relatively great plug-in depth, in comparison with its width, which affects the length of the entire plug-in sleeve.

Finally, DE 202 03 083 U1 discloses a frame-like spring contact for applying a circuit board and for accommodating a contact blade. This spring contact is also produced from a one-piece metal sheet by means of punching and bending, and has at least one pair of contact arms that lie opposite one another. This contact possesses a very small insertion depth, but is relatively great in volume, in total, because of its frame-shaped structure, and therefore is unsuitable for multi-point contact bushings in the standardized female multi-point connector raster dimension (2.54 mm). With this spring contact, the two ends of the punched sheet-metal part are formed into fixed contacts in the form of solder tags or surface mount device (SMD) contacts for the circuit board, and the spring arms are cut out in opposite directions, from the center of the punched sheet-metal part towards the fixed contact ends, whereby two crosspieces carried by edge ridges remain standing as an insertion aid for the contact blade. The punching and bending tool for the production of this spring contact therefore becomes relatively complicated.

SUMMARY OF THE INVENTION

Proceeding from this state of the art, it is an object of the present invention to provide a miniature spring bushing that is suitable for female multi-point connectors in the standardized raster dimension, possesses a low insertion depth and therefore a low construction height, creates great insertion security and therefore reliability of a connection, has a high current carrying capacity due to optimal material utilization, guarantees great contact reliability as the result of great contact forces, and allows material-saving and technologically advantageous production.

These and other objects are achieved, by providing a spring bushing for miniature plug-in connectors in accordance with the invention. The spring bushing has at least one housing chamber in a bushing housing for accommodating or receiving a one-piece contact spring. The contact-giving spring tongues of the spring are bent out of a flat sheet-metal punched part, at least on one side, without coverage. The one end of the sheet-metal punched part, a crosspiece that carries the spring tongue, forms a fixed connection, and the other free end forms the accommodation region for a contact blade. The contact-giving spring region of the contact spring is composed of three shanks. The outer contact-giving spring tongues are bent out from the crosspiece in the opposite direction from the center contact giving spring tongues. The outer contact-giving spring tongues are narrower than the center spring tongue.

The insertion depth of the contact spring for a contact blade is equal to or less than its insertion width. The contact spring carries guide ribs on the outside, proceeding from the crosspiece, with which ribs the contact spring is positioned in the chamber of the bushing housing. Advantageous embodiments are discussed below.

The core idea of the invention is that in the case of a spring bushing for miniature plug-in connectors, having at least one housing chamber in a bushing housing, for accommodating or receiving a one-part contact spring, the contact-giving spring tongues are bent out of a flat sheet-metal punched part, at least on one side, without coverage, whereby the one end of the sheet-metal punched part, a crosspiece that carries the spring tongues, forms a fixed connector, and the other end forms the free accommodation region for a contact blade, and the plug-in depth of the contact spring is dimensioned to be equal to or less than its plug-in width. In this way, the entire spring bushing becomes very short in the insertion direction. The contact-giving spring tongues accordingly apply rigidity for great contact forces, over a short length, and the spring tongues are not susceptible to bending and insertion tolerance default values. The spring tongues can be produced with particularly little material, because no cutouts occur, as in the case of contact springs produced by being cut out from sheet-metal plates in U shape. The contact springs are small and, in particular, very narrow. Therefore, the contact springs can be used very well in female multi-point connectors for a plug-in connection between electronic modules.

Preferably, the contact-giving spring region of the contact spring is punched and bent with three shanks, whereby the outer contact-giving spring tongues are bent out of the fixed connection region in the opposite direction from the center contact-giving spring tongue. In the case of a contact spring having three spring tongues, two spring tongues make contact on one contact blade side, and only one on the other side. Therefore, it has proven advantageous for splitting the current flow and the contact forces if the two outer spring tongues on the one contact blade side together take up as much punched sheet metal as the center spring tongue on the other side of the contact blade. The outer spring tongues are consequently narrower than the center spring tongue, particularly half as wide.

According to another embodiment, guide ribs are additionally punched out on the contact springs, on the outside, proceeding from the crosspiece as well as in one piece and in a plane with the crosspiece, with which ribs the contact spring is positioned in the housing chamber of the bushing housing. The guide ribs ensure hold of the contact springs in the chambers, in the correct position, and ensure an accurate fit for a contact blade multi-point connector. The guide ribs are dimensioned in approximately pin-like manner and are somewhat shorter than the spring tongues, and form a stop when the contact spring is pushed into the housing chamber of the bushing housing. For the fixed connector region of the contact spring, solder technology is preferably provided, preferably the SMD ("surface mounted device") solder method.

In another embodiment of the invention, the bushing housings carry shield plates for shielding against high-frequency electromagnetic interference signals. For this purpose, the shield plates are snapped onto at least two opposite sides of a housing bushing, on the outside, and are soldered to a ground connector or the circuit board or card.

For correct positioning of the spring bushing on a circuit board or card, positioning pins are molded onto the bushing housing, in a further embodiment. The positioning pins are introduced into correspondingly shaped openings in the circuit board or card. In this way, erroneous insertion with the sides reversed ("incorrect poling") is prevented by means of the different shape of the positioning pins and openings.

Although the spring bushing according to the invention can also be configured as a single-pole bushing, its main area of application is seen as being that of a multi-pole female connector for connecting electronic modules.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawing, wherein similar reference characters denote similar elements throughout the several views.

DETAILED DESCRIPTION OF THE PREFERRED EMBODIMENTS

Figure 1:
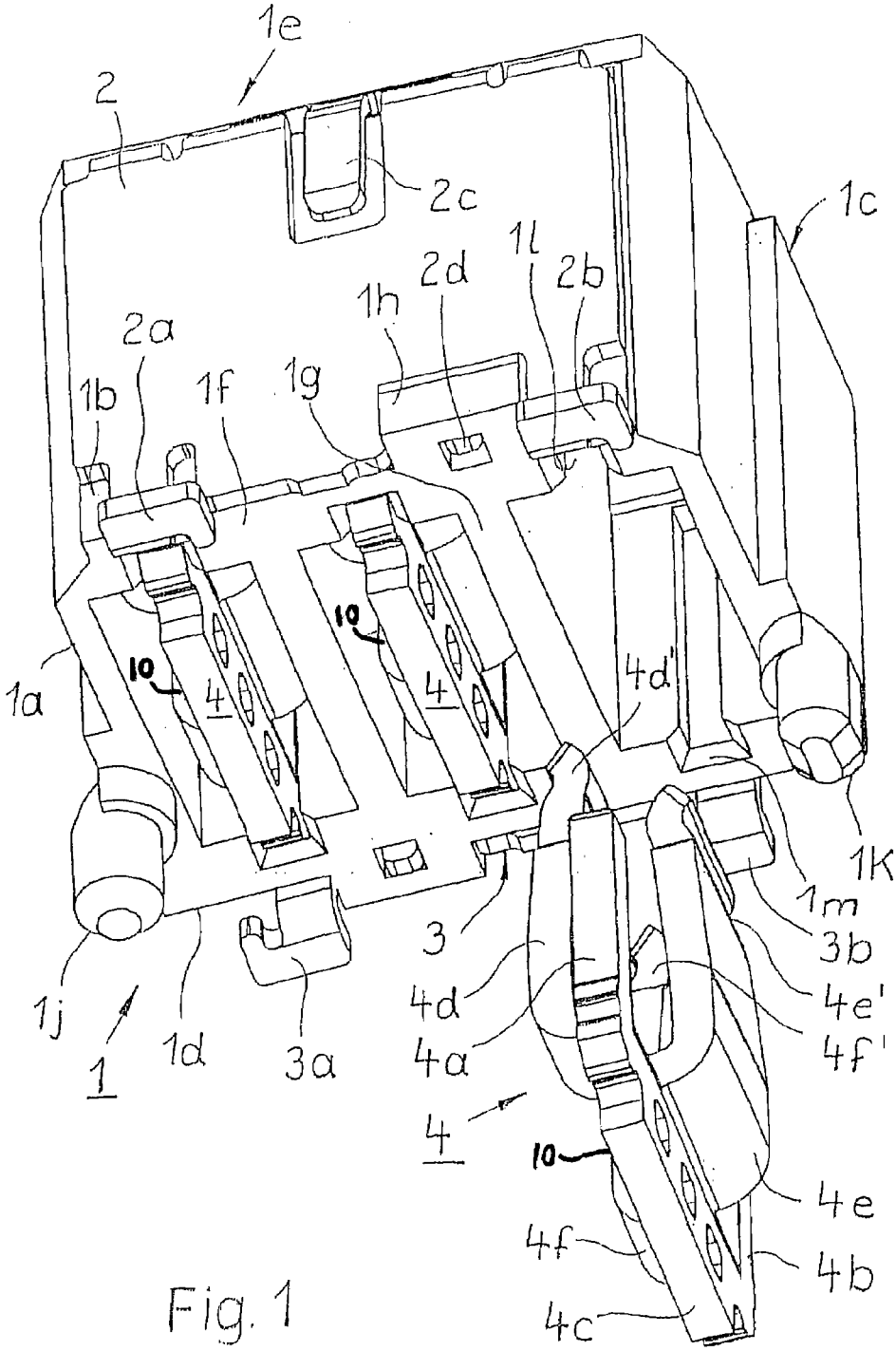
FIG. 1 is a view of a spring bushing with partially assembled contact springs.

Referring to FIG. 1, the spring bushing possesses a bushing housing 1, composed of a plastic injection-molded part that has four side walls 1*a*, 1*b*, 1*c*, 1*d*, a bottom 1*e*, and partitions 1*f*, 1*g* in the interior. On the bottom, openings that are not visible in FIG. 1 are provided. Through these openings electrical contact blades of a plug can reach. On the opposite side walls 1*b*, 1*d*, shield plates 2, 3 are engaged in place, which are soldered to a card or circuit board, not shown, with their SMD connectors 2*a*, 2*b*; 3*a*, 3*b*. Hook-like and pin-like projections or snap hooks 2*c*, 2*d* on the shield plates 2, 3 as well as housing projections 1*h*, 1*i* on the side walls 1*b*, 1*d* serve for engagement. Furthermore, two positioning pins 1*j*, 1*k* that have different shapes are injection-molded onto the bushing housing 1, which are extended in the direction of the assembly plane and engage into correspondingly shaped bores of the circuit board or card. In this way, the spring bushing can be assembled in the correct position and secured against rotation.

Two partitions 1*f*, 1*g* divide the bushing housing 1 into three parallel chambers in the embodiment shown in FIG. 1. The number of chambers determines the maximum number of poles 10. A contact spring 4 is inserted into each chamber, whereby guide ribs 4*a*, 4*b* on the contact springs 4 dip into guide grooves 11, 1*m*, until they sit on the base of the housing bottom 1*e*. A contact spring 4 is punched in one piece from a sheet of metal, and bent. The guide ribs 4*a*, 4*b*, together with a crosspiece 4*c* that simultaneously forms the fixed connector, form a flat "U." From the crosspiece 4*c*, three spring tongues 4*d*, 4*e*, 4*f* proceed towards the inside, without coverage. The center, broader spring tongue 4*e* is bent out towards one direction, and the two outer, narrower spring tongues 4*d*, 4*f* are bent out towards the other side. In this way, a lyre-shaped accommodation space having insertion aids 4*d*', 4*e*', 4*f*' for a contact blade is formed between the spring tongues 4*d*, 4*e*, 4*f* in the side view of a contact spring 4. According to one variant, however, it is also possible to bend out only the spring tongue(s) (4*d*, 4*f*, or 4*e*) on one side. The other spring tongue(s) (4*e* or 4*d*, 4*f*) then remain in the plane of the crosspiece 4*c* and the guide ribs 4*a*, 4*b*. The three spring tongues 4*d*, 4*e*, 4*f* are therefore at most bent, but by no means twisted, and create the accommodation space for the contact blade over a short length, and the necessary plug-in and contact force.

"Short length" in the sense of the invention means that the maximal insertion length "T" of a contact blade into the spring contact 4 is less than or equal to the maximally possible insertion width "B" of a contact blade. Because of the compact construction of the bushing housing 1, the entire spring bushing has a particularly compact construction. Also, as the distance is short from the crosspiece 4*c* of to the free ends of springs contact 4, which have the insertion aids 4*d*', 4*e*', 4*f*', the insertion tolerances for a contact blade are reduced.

This feature has a particularly advantageous effect in the case of multi-pole spring bushings, particularly in the case of one-row or multi-row female multi-point connectors. Aside from improved insertion tolerances for contact blades, more uniform and therefore more secure contact and plug-in forces also result in the case of multi-pole spring bushings, as compared with the individual plug-in contact connections with one another. Also the risk of bending of contact blades of a corresponding male multi-point connector when the male connector is plugged on is practically excluded, because the contact blades are also shorter, and thereby more rigid, viewed over their length. Furthermore, the tolerance problems of male multi-point connectors are no longer as severe because of the shorter contact blades. Of course, the construction height of the male multi-point connectors is also reduced accordingly in the case of shorter contact blades. Because of the utilization of the full area of sheet metal for punching, the current carrying capacity of the contact springs also increases in comparison with spring bushings whose contact springs are cut from a "U" at the same area of sheet metal for punching, and rotated relative to one another in such a manner that the springs stand opposite one another. Furthermore, echo signals are avoided, which can occur in the case of long plug-in contacts due to running time differences of high-frequency currents from the contacting zone all the way to the blade contact tip and back. Since a contact spring according to the invention can be punched and bent in a few simple work steps, it is possible to use simple punching and bending tools. As a result, not only the material costs but also the production costs are reduced.

Figure 2:
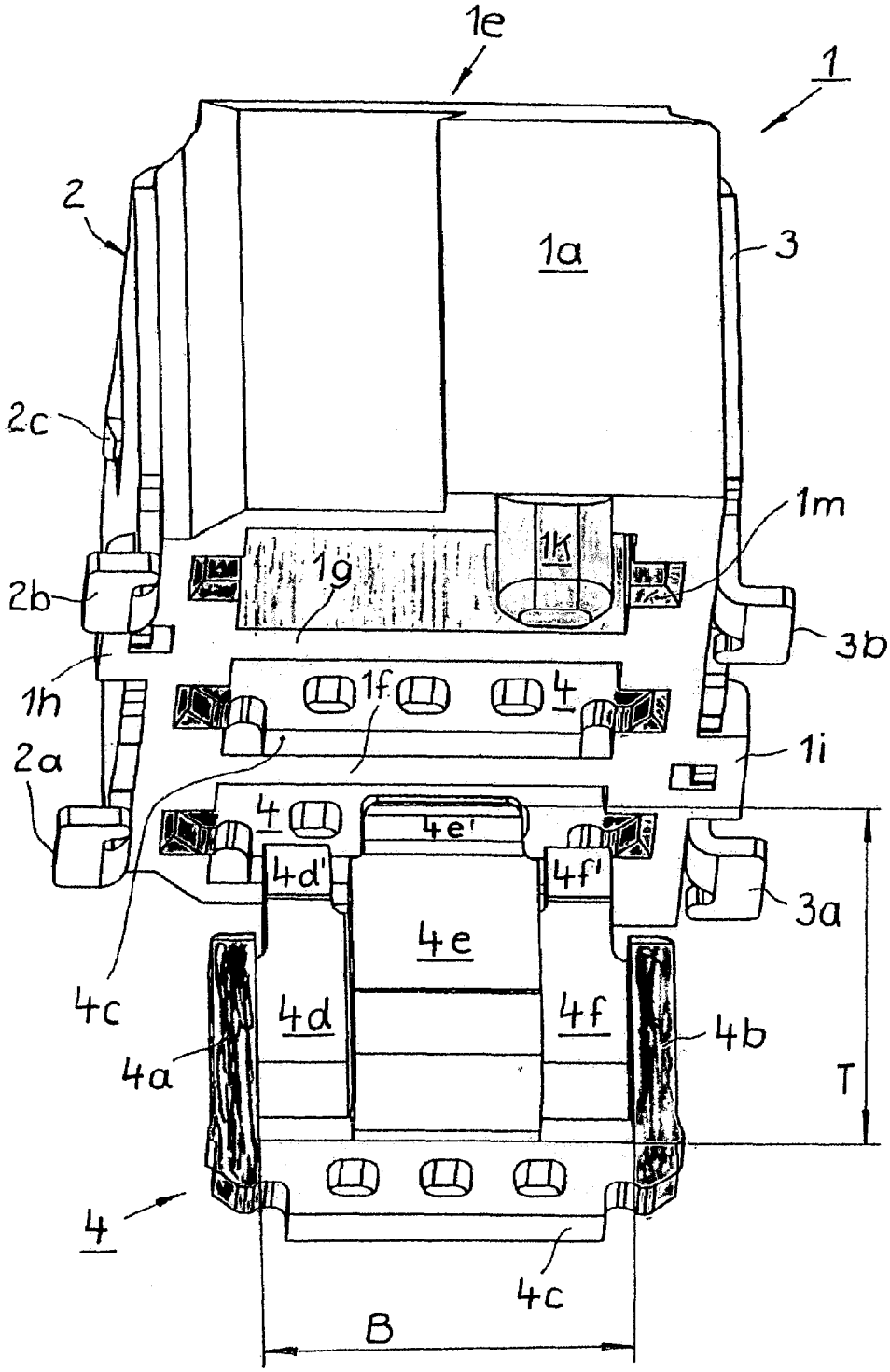
FIG. 2 is a view of the spring bushing rotated by 90 degrees relative to FIG. 1.

In the view of the spring bushing according to FIG. 2, which was turned by 90°, the same reference symbols are used as in FIG. 1, if these parts are visible; the dimensions of the two guide ribs 4*a*, 4*b* and the three spring tongues 4*d*, 4*e*, 4*f* on the spring contact 4 that has not yet been inserted into the free housing chamber of the bushing housing 1, relative to one another, can be clearly seen. The maximally possible insertion depth (length) (T) for a contact blade from the free ends 4*d*', 4*e*', 4*f*' of the spring tongues 4*d*, 4*e*, 4*f*, bent away to form an insertion aid, to the crosspiece 4*c* is visibly smaller, in the embodiment shown, than the distance from the guide rib 4*a* to the guide rib 4*b*, which determines the maximal insertion width (B) for a contact blade.

Although at least one embodiment of the present invention has been shown and described, it is to be understood that many changes and modifications may be made thereunto without departing from the spirit and scope of the invention as defined in the appended claims.

What is claimed is:

1. A spring bushing for a miniature plug-in connector comprising:

(a) a bushing housing having at least one housing chamber;

(b) a one-piece contact spring received in said at least one housing chamber, said contact spring comprising first and second outer contact-providing spring tongues and a center contact-providing spring tongue bent out at least on one side of a flat sheet-metal punched part, said sheet-metal punched part comprising a first end and a second free end, said first end comprising a crosspiece carrying said spring tongues, said crosspiece forming a fixed connector, said outer contact-providing spring tongues being narrower in width than said center contact-providing spring tongue and being bent out from the crosspiece in a direction opposite from the center contact-providing spring tongue; and (c) a plurality of guide ribs carried on an outside portion of said contact spring proceeding from said crosspiece, said ribs positioning the contact spring in said at least one housing chamber;

wherein the contact spring has an insertion depth and an insertion width for a contact blade, said insertion depth being less than or equal to said insertion width.

2. The spring bushing according to claim 1, wherein the guide ribs in width are narrower than the outer contact-providing spring tongues.

3. The spring bushing according to claim 2, wherein the guide ribs are shorter than the contact-providing spring tongues and lie in a plane with the crosspiece.

4. The spring bushing according to claim 1, wherein the fixed connector comprises surface mount device (SMD) contacts.

5. The spring bushing according to claim 1, wherein the bushing housing carries a plurality of shielding plates, at least one of said shielding plates being on a side of the bushing housing opposite to another of said shielding plates.

6. The spring bushing according to claim 5, wherein the shielding plates comprise snap-on attachment devices for the bushing housing.

7. The spring bushing according to claim 5, wherein the shielding plates are attached to a circuit board or card using SMD technology.

8. The spring bushing according to claim 1, further comprising a plurality of positioning pins provided on the bushing housing for a circuit board.

9. The spring bushing according to claim 8, wherein the positioning pins are configured differently for the purpose of "incorrect poling" of the spring bushing.

10. The spring bushing according to claim 1, wherein the spring bushing has multiple poles.

* * * * *